United States Patent [19]

Corson

[11] 4,024,701

[45] May 24, 1977

[54] GRAVITY POWERED TIMERS

[76] Inventor: Wynne Rinnman Corson, 1046 Dodge Ave., Evanston, Ill. 60202

[22] Filed: Sept. 8, 1975

[21] Appl. No.: 611,141

[52] U.S. Cl. ..... 58/144; 58/1 R

[51] Int. Cl.[2] ..... G04F 1/08

[58] Field of Search ..... 58/1, 144; 84/404

[56] References Cited

UNITED STATES PATENTS

| | | | |
|---|---|---|---|
| 2,417,641 | 3/1947 | Fischer | 58/144 |
| 2,738,697 | 3/1956 | Miller | 84/404 |
| 3,522,701 | 8/1970 | Perry | 58/1 R |

*Primary Examiner*—E. S. Jackmon

*Attorney, Agent, or Firm*—Lockwood, Dewey, Zickert & Alex

[57] ABSTRACT

A gravity powered timing device is described which is of generally rectangular cross-section, the perimeter portions of which include a plurality of inclined track sections which successively communicate with each other to define a descending track of predetermined finite length. A free rolling ball is adapted to travel downwardly along such track and, at the terminal portion of each track section, is prevented from achieving undesired high speed by collision with the wall portion for the next successive track section. The terminal portion of the lowermost of said inclined track sections is in overlying relationship with a sounding plate, whereby a ball travelling successfully downwardly along the track will be discharged onto the sounding plate and thereby produce an audible signal. If desired, a similar sounding plate can be provided at the upper end of the device, thereby enabling a repeat of the timing cycle to be accomplished by simply inverting the device. In a preferred embodiment, the track sections can be of modular construction, thereby enabling the operator to selectively regular the track length and hence the duration of the timing cycle.

5 Claims, 8 Drawing Figures

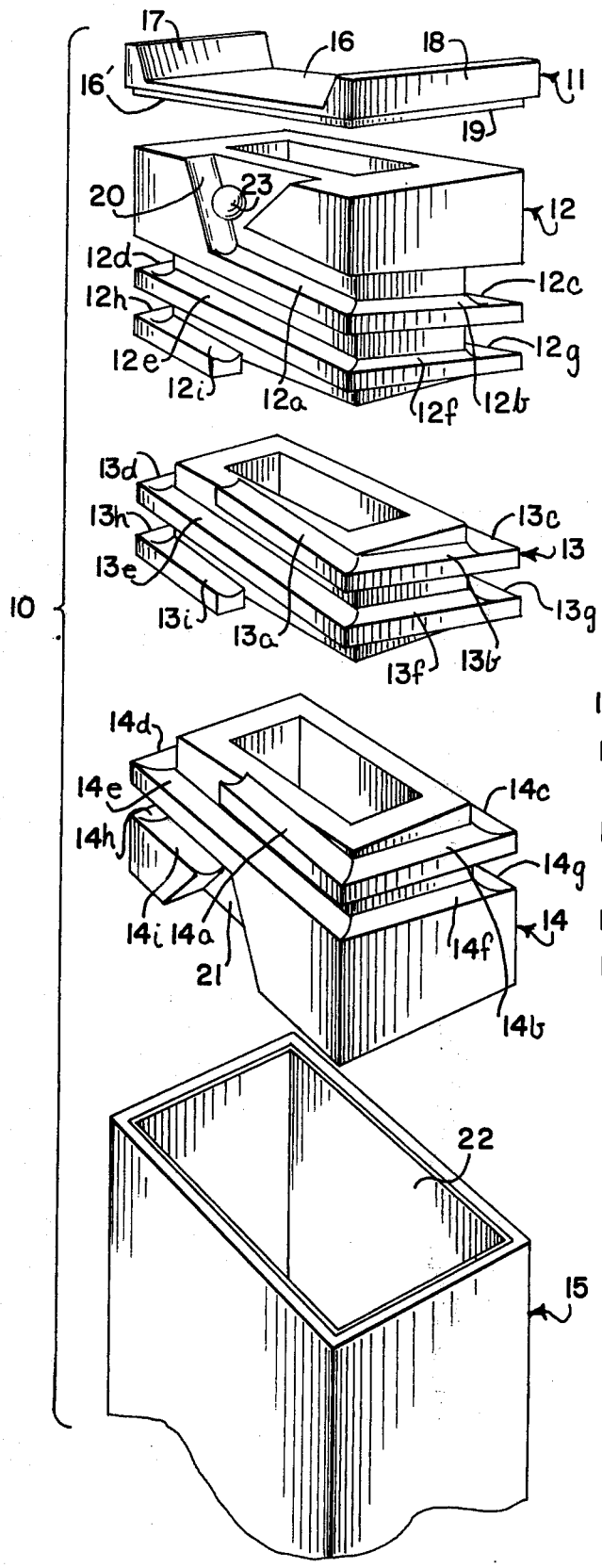
FIG. 1
FIG. 2
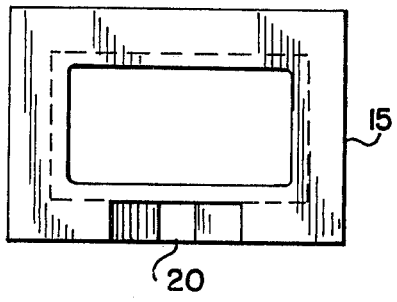
FIG. 3
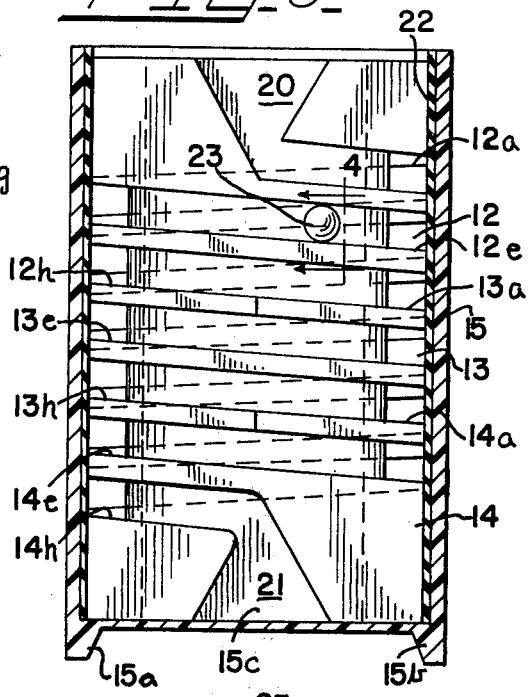
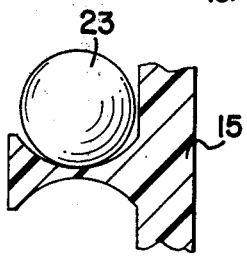
FIG. 4
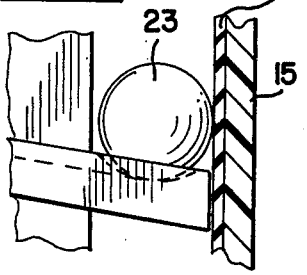
FIG. 5

FIG. 6
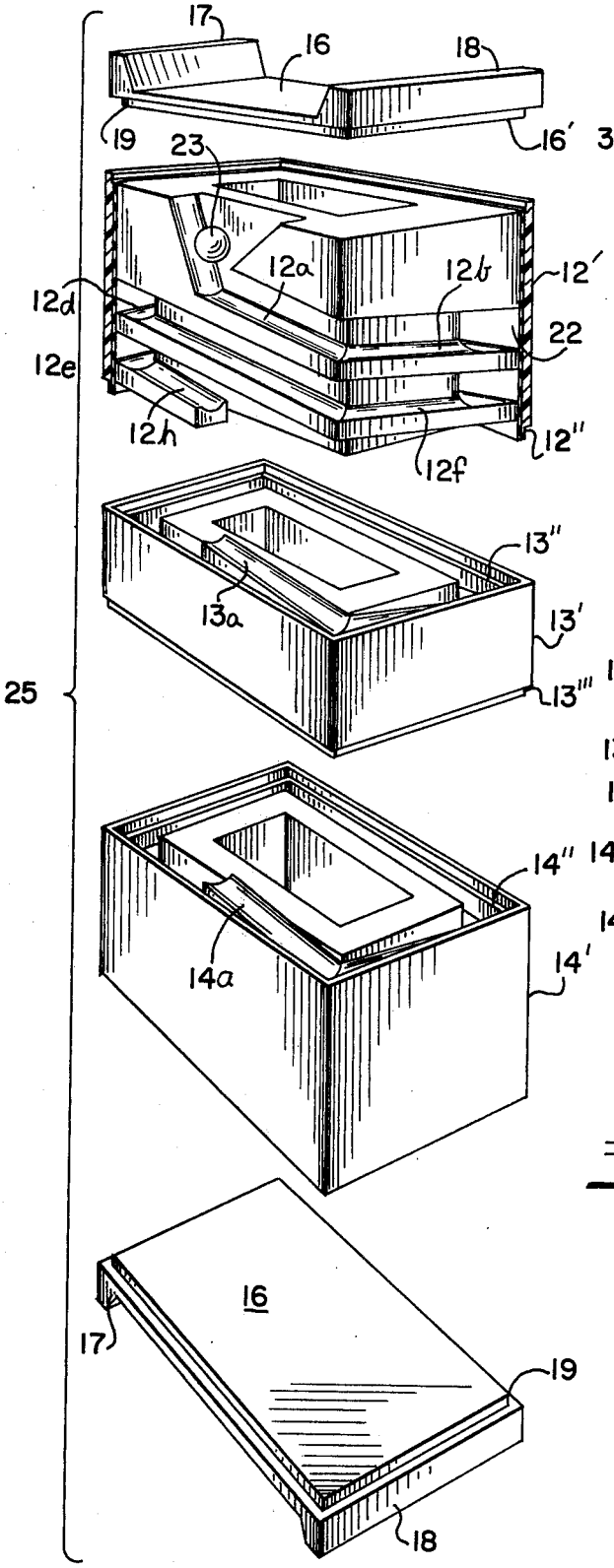
FIG. 8
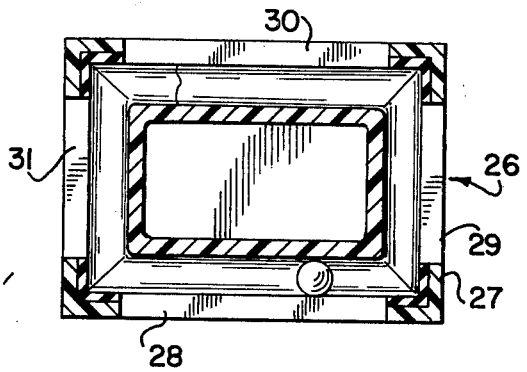
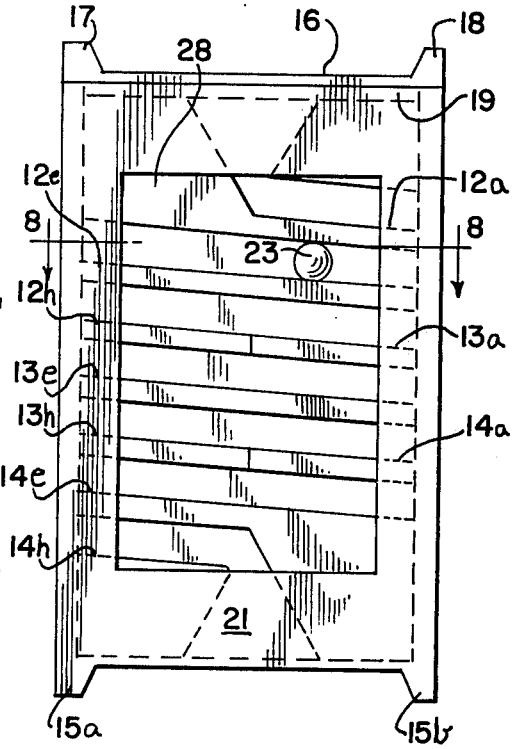
FIG. 7

GRAVITY POWERED TIMERS

BACKGROUND AND DESCRIPTION OF THE INVENTION

This invention generally relates to improvements and innovations in timing devices and, more particularly, is directed to an improved gravity powered timing device which produces an audible signal after a precisely measured and regulated fixed period of time.

While the prior art discloses numerous timing devices of the general type wherein a ball or similar rolling device under the influence of gravity traverses a predetermined path and then drops upon a sounding device, these prior art devices have been characterized by certain disadvantages which have rendered them less than fully satisfactory. For example, in U.S. Pat. No. 2,417,641 which issued to Charles Fisher, a gravity type timer device is described which is characterized by a ball chute of coiled wire which is of fixed length. As such, this device does not exhibit the degree of timing cycle variability which is desired to enable that device to be used in a wide variety of applications. Other prior art gravity type timer devices have been characterized by similar problems and disadvantages which have, accordingly, precluded the full commercialization thereof.

The present invention overcomes the problems and disadvantages of these prior art devices by providing a novel gravity powered timing device which is of modular construction and of generally rectangular cross-section. The perimeter portions of this device include a plurality of inclined track sections which successively communicate with each other to define a track of predetermined finite length which, by reason of the modular construction, can be increased or decreased to enable the operator to selectively vary the duration of the timing cycle. A free rolling ball is adapted to travel downwardly along the track and, at the terminal portion of each of the track sections, is prevented from achieving undesired high speed by collision with the wall portion of the next successive track section. The terminal portion of the lowermost of these inclined track sections is, in the illustrated embodiment, in overlying relationship with a sounding plate, whereby a ball travelling downwardly along the track will be discharged onto the sounding plate and thereby produce an audible signal. If desired, a similar sounding plate can be provided at the upper end of the device, thereby enabling repeat of the timing cycle to be effected by simply inverting the device.

It is a general object of the invention to provide an improved gravity powered timing device.

Another object of the present invention is to provide an improved gravity powered timing device which produces an audible signal after a selected period of time.

A further object of the present invention is to provide a gravity powered timing device which includes a descending track in the form of a plurality of successively interconnected downwardly inclined track sections wherein speed retarding means are provided at the terminal portions of each of said downwardly inclined track sections.

A further object of the present invention is to provide an improved gravity powered timing device which produces an audible signal and which can be inverted when reuse thereof is desired.

A further object of the present invention is to provide a gravity powered timing device which includes a series of inclined planes which successively communicate with each other wherein said inclined planes are incorporated in a plurality of modular groups which can be interconnected with each other to selectively regulate the length of said track. These and other objects of the present invention will be apparent to those skilled in the art from the following detailed description of a preferred embodiment thereof, taken in conjunction with the following drawings wherein:

FIG. 1 is an exploded perspective view of a gravity powered timing device embodying the features of the present invention;

FIG. 2 is a plan view of the uppermost module of the timing device shown in FIG. 1;

FIG. 3 is a vertical sectional view of the timing device shown in FIG. 1;

FIG. 4 is a sectional view taken along the line 4—4 of FIG. 3;

FIG. 5 is a fragmentary elevational view of the timing device shown in FIG. 1 with the ball member thereof shown in engagement with a wall section of the device stationed at the terminal portion of the illustrated track section, said wall portion being shown in section;

FIG. 6 is an exploded perspective view of a modified timing device also embodying features of the present invention, with a portion of the uppermost module thereof removed to illustrate the interior construction thereof;

FIG. 7 is a side elevational view of another embodiment of the present invention; and FIG. 8 is a sectional view taken along the line 8-8 of FIG. 7.

Referring to the drawings, and with particular reference to FIG. 1, a gravity powered timing device embodying features of the present invention is generally designated by the reference numeral 10. As shown, the device 10 includes a top plate 11, a first or uppermost module 12, an intermediate module 13, a lower or bottommost module 14, and an open-topped container 15 which is of generally rectangular cross-section and which has an interior compartment which is sized to receive, in stacked relation, the individual modules 12, 13 and 14 with the top plate 11 thereover.

As shown in FIG. 1, the top plate 11 includes a generally planar top surface 16 which, adjacent its lateral margins, extends into a pair of upstanding leg-like projections 17 and 18 corresponding to the legs **15*a* and 15*b* of the container 15 as shown in FIG. 3. In addition, the bottom surface 16' of top plate 11 is provided with a collar 19 which is of rectangular cross-section and sized to form a compression fit with the side walls adjacent the upper end of open-topped container 15**.

The first or uppermost module 12, in the illustrated embodiment, is of generally rectangular cross-section and includes a funnel inlet portion 20 which feeds into a series of inclined track sections **12*a*–*i* which successively communicate with each other to define a decending track unit for that module. Similarly, intermediate module 13 and bottom module 14, respectively include a plurality of inclined track sections 13*a*–*i* and 14*a*–*i* which likewise successively communicate with each other. As best shown in FIGS. 1 and 3, the lowermost track section 14*i* of bottom module 14 discharges into an inverted funnel-shaped section 21**.

Referring to FIG. 3, it will be noted that the interior of container 15 has a liner 22, preferably composed of a resilient rubber-like or plastic material. This resilient liner serves two functions. Initially, it facilitates a compression fit between the collar 19 and the uppermost portions of the side walls of the open-topped container 15. Additionally, since an important aspect of the present invention contemplates the impact of a spherical striker or ball 23 with a wall section stationed at the terminal portion of each of the inclined track sections, the liner 22 functions to both cushion and silence this impact.

As best shown in FIGS. 4 and 5, each of the inclined track sections preferably includes a dished upper and lower surface which directs travel along the respective track sections in a straight line fashion. The purpose for dishing both the upper and lowermost sections of the track as depicted in FIG. 4 is, of course, to afford the similar grooved track for directing travel of the ball when the device 11 is both right-side up and up-side down.

It is important to note that in each revolution of travel the ball 23 will be retarded by reason of impact with the lining 22 four separate times. Hence, this speed retarding feature of the present invention greatly reduces the size of the timer required for providing a given timing cycle. Additionally, another important feature of the present invention concerns the discharge of the ball 23 from the lowermost track section **14*i* of bottom module 14 onto a planar bottom surface of container 15 which is not covered by the resilient liner 22 and which, accordingly, functions as a drum or sounding plate for the falling ball 23, thus producing an audible signal indicating the end of the timing cycle or period. As can be well appreciated, at the end of that timing cycle or period, the device shown in FIGS. 1–5** can be inverted, resulting in the ball then travelling again through its oft-interrupted journey of another and equal time period.

The embodiment of the present invention depicted in FIG. 6 and designated by the reference numeral 25 is of generally similar construction to that previously described in conjunction with FIGS. 1–5 and, accordingly, like reference numerals have been used to depict elements thereof which are of similar construction and operation to that of the previously described embodiment. In this regard, however, it should be noted that the timing device 25 differs from the previous embodiment in that each of the modules 12′, 13′ and 14′ has an outer wall integrally formed therewith. This wall includes an interior liner 22 similar to that identified by the same reference numeral in the previous embodiment which both functions to cushion and silence impact of the ball 23 as it travels down the individual track sections. As will be appreciated, since the timer 25 does not contemplate a container 15 of fixed size, it can be selectively in creased or decreased in height by merely adding or taking away individual modules to provide a track length which produces the time duration desired to be measured. As shown, the lowermost portion of module 12′ is provided with a downwardly extending lip 12″ which is adapted to be received, in mating engagement, with an internal shelf 13″ adjacent the upper end of the module 13′. Likewise, the module 13′ includes a downwardly extending lip 13‴ which is sized to be matingly received within a similar shelf 14″ in the bottommost module 14′. This lip-shelf arrangement provides stacking stability to the device 25 and also functions to assure proper alignment of the respective track sections.

FIGS. 7 and 8 depict a further embodiment of timing device 26 which is generally similar to the timing device described in conjunction with FIGS. 1–5. In particular, the interior construction of the timing device 26 is identical to that of the timing device 10, however, the device 26 includes a container or housing 27 which incorporates a plurality of transparent panels 28, 29, 30 and 31 for affording the operator the opportunity to visually observe the spherical member 23 as it travels downwardly along each of the successive inclined track sections.

It will be apparent to those skilled in this art that modifications and variations to the previously described embodiment may be made without departing from the spirit and scope of this invention. Accordingly, the present invention is to be construed and limited only be the scope of the appended claims.

I claim:

1. A gravity powered timing device, comprising: a generally spherical striker means; a plurality of inclined planes successively communicating with each other to define a descending track of a predetermined finite length, each of said successively communicating descending inclined planes being arranged at substantially right angles to each other, whereby said plurality of inclined planes are characterized by a generally rectangular cross-sectional configuration, said inclined planes being adapted to receive said striker means for gravity-induced downward travel of said striker means along said track; the uppermost inclined plane of said plurality of successively communicating inclined planes including an entrance means comprising outwardly extending diverging walls which form a first feeder means that guides said striker means into said entrance means for subsequent travel along said descending track, speed retarding means at the terminal portion of said inclined planes for contacting said spherical striker means when it reaches the terminal portion of said inclined plane to controllably retard the gravity-induced downward travel of said spherical striker means as it travels from each of said inclined planes to the next succeeding inclined plane of said track; and, a sounding plate positioned at the terminal portion of the lowermost of said inclined planes and adapted to receive said striker means upon its being discharged from said lowermost inclined plane to produce an audible signal, the terminal portion of the lowermost of said plurality of inclined planes directly communicating with a discharge means which includes outwardly extending diverging walls that direct said striker means onto said sounding plate, said discharge means also functioning as a second feeder means when said timing device is inverted.

2. The gravity powered timing device of claim 1 wherein said inclined planes are included in a plurality of modular groups which can be interconnected with each other to selectively regulate the predetermined finite length of said track.

3. The gravity powered timing device of claim 1 wherein said speed retarding means comprises an abutment positioned at the terminal portion of at least a substantial number of said inclined planes which functions to block further travel of said spherical striker means along the path defined by the upstream inclined plane associated therewith and to direct said spherical striker means into a direction of travel coincident with the downstream inclined plane associated therewith.

4. The gravity powered timing device of claim 1 wherein said plurality of inclined planes are arranged and sized to be removably received within an outer casing.

5. The gravity powered timing device of claim 4 wherein at least a portion of said outer casing is constructed to provide viewing of said spherical striker means as it travels down said plurality of inclined planes.

* * * * *